US012565691B2

(12) United States Patent
Wada et al.

(10) Patent No.: US 12,565,691 B2
(45) **Date of Patent: *Mar. 3, 2026**

(54) STEEL SHEET, MEMBER, AND METHODS FOR MANUFACTURING THE SAME

(71) Applicant: JFE Steel Corporation, Tokyo (JP)

(72) Inventors: Yusuke Wada, Tokyo (JP); Tatsuya Nakagaito, Tokyo (JP); Shotaro Terashima, Tokyo (JP); Lingling Yang, Tokyo (JP); Takeshi Yokota, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 638 days.

This patent is subject to a terminal disclaimer.

(21) Appl. No.: 17/800,957

(22) PCT Filed: Feb. 24, 2021

(86) PCT No.: PCT/JP2021/006716

§ 371 (c)(1),
(2) Date: Aug. 19, 2022

(87) PCT Pub. No.: WO2021/172299

PCT Pub. Date: Sep. 2, 2021

(65) Prior Publication Data

US 2023/0072557 A1 Mar. 9, 2023

(30) Foreign Application Priority Data

Feb. 28, 2020 (JP) ..... 2020-033057

(51) Int. Cl.

| | |
|---|---|
| ***C21D 9/46*** | (2006.01) |
| ***C21D 8/02*** | (2006.01) |
| ***C21D 8/0221*** | (2026.01) |
| ***C21D 8/0247*** | (2026.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C23C 2/40*** | (2006.01) |

(52) U.S. Cl.

CPC ..... *C21D 9/46* (2013.01); *C21D 8/0226* (2013.01); *C21D 8/0236* (2013.01); *C21D 8/0273* (2013.01); *C22C 38/001* (2013.01); *C22C 38/002* (2013.01); *C22C 38/02* (2013.01); *C22C 38/04* (2013.01); *C22C 38/06* (2013.01); *C23C 2/40* (2013.01); *C21D 2211/001* (2013.01); *C21D 2211/002* (2013.01); *C21D 2211/003* (2013.01); *C21D 2211/005* (2013.01); *C21D 2211/008* (2013.01)

(58) Field of Classification Search

CPC ..... C21D 2211/001; C21D 2211/002; C21D 2211/003; C21D 2211/005; C21D 2211/008; C21D 6/008; C21D 8/0205; C21D 8/0226; C21D 8/0236; C21D 8/0273; C21D 9/46; C22C 38/001; C22C 38/002; C22C 38/005; C22C 38/008; C22C 38/02; C22C 38/04; C22C 38/06; C22C 38/08; C22C 38/12; C22C 38/14; C22C 38/38; C22C 38/60; C23C 2/0222; C23C 2/06; C23C 2/28; C23C 2/40

See application file for complete search history.

(56) References Cited

U.S. PATENT DOCUMENTS

| | | | | |
|---|---|---|---|---|
| 8,137,487 | B2 | 3/2012 | Nonaka et al. | |
| 8,657,969 | B2 | 2/2014 | Kawasaki et al. | |
| 8,951,366 | B2 | 2/2015 | Sano et al. | |
| 9,028,626 | B2 | 5/2015 | Nakagaito et al. | |
| 12,258,647 | B2 * | 3/2025 | Wada | C22C 38/16 |
| 2020/0230918 | A1 * | 7/2020 | Morishita | C22C 38/32 |
| 2021/0207234 | A1 | 7/2021 | Takashima et al. | |

FOREIGN PATENT DOCUMENTS

| | | | |
|---|---|---|---|
| CN | 109642281 | A | 4/2019 |
| CN | 115151672 | A | 10/2022 |
| EP | 2 738 276 | A1 | 6/2014 |
| EP | 3101147 | A1 | 12/2016 |
| EP | 3346019 | A1 | 7/2018 |

(Continued)

OTHER PUBLICATIONS

Office Action (Written Decision on Registration) issued Mar. 27, 2025, by the Korean Intellectual Property Office in corresponding Korean Patent Application No. 10-2022-7028807 and an English translation of the Office Action. (6 pages).

International Search Report and Written Opinion for International Application No. PCT/JP2021/006716, dated May 18, 2021, 6 pages.

Chinese Office Action with Search Report for Chinese Application No. 202180016639.7, dated Mar. 23, 2023, 9 pages.

Extended European Search Report for European Application No. 21759663.4, dated Apr. 25, 2023, 8 pages.

Chinese Office Action for Chinese Application No. 202180016639.7, dated Sep. 21, 2023 with Concise Statement of Relevance of Office Action, 5 pages.

Office Action issued by the U.S. Patent and Trademark Office in the U.S. Appl. No. 17/800,669, mailed Aug. 16, 2024, U.S. Patent and Trademark Office, Alexandria, VA. (11 pages).

(Continued)

*Primary Examiner* — Rebecca Janssen
*Assistant Examiner* — Mayela Aldaz
(74) *Attorney, Agent, or Firm* — Buchanan Ingersoll & Rooney PC

(57) ABSTRACT

A steel sheet according to the present invention has a specific chemical composition and a steel microstructure including, in terms of area fraction, ferrite: 20% or more and 60% or less, a total of bainite and tempered martensite: 25% or more and 60% or less, retained austenite: 7% or more and 20% or less, fresh martensite: 8% or more and 40% or less, and the remainder: 5% or less. Cementite particles are present in the retained austenite, a ratio of an area fraction of the cementite particles in the retained austenite to an area fraction of the retained austenite is 5% or more and 25% or less, and the steel sheet has a tensile strength of 980 MPa or more.

16 Claims, No Drawings

(56) References Cited

FOREIGN PATENT DOCUMENTS

| | | | | | |
|---|---|---|---|---|---|
| EP | 3444372 | A1 | * | 2/2019 | ..... C21D 6/004 |
| EP | 3476963 | A1 | | 5/2019 | |
| EP | 4079883 | A1 | | 10/2022 | |
| JP | H02101117 | A | | 4/1990 | |
| JP | 2004256872 | A | | 9/2004 | |
| JP | 2008308717 | A | | 12/2008 | |
| JP | 2010275627 | A | * | 12/2010 | |
| JP | 4894863 | B2 | | 3/2012 | |
| JP | 4903915 | B2 | | 3/2012 | |
| JP | 5463685 | B2 | | 4/2014 | |
| JP | 2015-105383 | A | | 6/2015 | |
| KR | 2014-0026628 | A | | 3/2014 | |
| WO | 2006038708 | A1 | | 4/2006 | |
| WO | 2009096344 | A1 | | 8/2009 | |
| WO | 2011093319 | A1 | | 8/2011 | |
| WO | 2012118081 | A1 | | 9/2012 | |
| WO | 2017179372 | A1 | | 10/2017 | |
| WO | 2018122679 | A1 | | 7/2018 | |
| WO | WO-2019026116 | A1 | * | 2/2019 | ..... C23C 2/40 |

OTHER PUBLICATIONS

Office Action issued by the U.S. Patent and Trademark Office in the U.S. Appl. No. 17/800,650, mailed Jun. 3, 2025, U.S. Patent and Trademark Office, Alexandria, VA. (11 pages).

* cited by examiner

STEEL SHEET, MEMBER, AND METHODS FOR MANUFACTURING THE SAME

CROSS REFERENCE TO RELATED APPLICATIONS

This is the U.S. National Phase application of PCT/JP2021/006716, filed Feb. 24, 2021, which claims priority to Japanese Patent Application No. 2020-033057, filed Feb. 28, 2020, the disclosures of these applications being incorporated herein by reference in their entireties for all purposes.

FIELD OF THE INVENTION

The present invention relates to a steel sheet which has high strength, good ductility, and good stretch flangeability and in which deterioration of ductility under high strain rate is suppressed, a member, and methods for manufacturing the same. The steel sheet according to aspects of the present invention can be suitably used for parts mainly used in the automotive field.

BACKGROUND OF THE INVENTION

In recent years, in view of global environmental conservation, an improvement in the fuel efficiency of automobiles has been an important issue, and a reduction in the weights of car bodies and an improvement in crashworthiness of automobiles have been desired. In order to meet the above demand, a demand for high strength steel sheets has been increasing as steel sheets for automobiles. However, in general, an increase in the strength of a steel sheet decreases formability. Therefore, the development of a steel sheet that achieves both high strength and high formability has been desired.

In forming of a high strength steel sheet into parts having complicated shapes, such as automotive parts, the occurrences of cracking and necking in stretched portions and stretch flange portions are serious problems. Thus, there is also a demand for a high strength steel sheet having both an increased elongation and an increased hole expansion ratio that can overcome the problems of the occurrences of cracking and necking. Furthermore, in the actual press forming, steel sheets are subjected to forming at high strain rate in order to improve productivity. Accordingly, there is a demand for a steel sheet having an elongation that does not decrease even at high strain rate in addition to an elongation at low strain rate, which is evaluated by a normal tensile test.

In order to enhance both strength and formability, various multi-phase high strength steel sheets such as ferrite-martensite dual phase steel (dual phase (DP) steel) and TRIP steel, which utilizes the transformation-induced plasticity of retained austenite, have been manufactured to date.

For example, Patent Literature 1 discloses a method for manufacturing a high strength steel sheet that achieves high ductility by adding a large amount of Si, annealing a cold-rolled steel sheet in a dual phase region, subsequently performing holding in a bainite transformation region of 300° C. to 450° C. to ensure a large amount of retained austenite.

Patent Literature 2 discloses a method for manufacturing a high strength cold-rolled steel sheet that achieves a high hole expansion ratio by providing a microstructure composed of ferrite and tempered martensite while adding Si and Mn in large amounts.

As a method for increasing both the elongation and hole expansion ratio, there has been the development of a technique of reducing the difference in hardness between microstructures by introducing tempered martensite or bainite. For example, Patent Literature 3 discloses a technique of achieving a high elongation and a high hole expansion ratio by providing a microstructure composed of ferrite, tempered martensite, and retained austenite. Furthermore, Patent Literature 4 discloses a technique of achieving a high elongation and a high hole expansion ratio by providing a microstructure composed of ferrite, bainite, and retained austenite.

A method of controlling a carbide precipitated in steel is also effective. Patent Literature 5 discloses a technique of achieving a high elongation and a high hole expansion ratio by providing a microstructure composed of ferrite, a low-temperature transformed phase, and retained austenite, and reducing the particle size of a carbide in the low-temperature transformed phase. Patent Literature 6 discloses a technique of achieving a high elongation and a high hole expansion ratio by optimizing annealing conditions in steel containing retained austenite to control the size and morphology of cementite.

PATENT LITERATURE

PTL 1: Japanese Unexamined Patent Application Publication No. 2-101117

PTL 2: Japanese Unexamined Patent Application Publication No. 2004-256872

PTL 3: Japanese Patent No. 5463685

PTL 4: Japanese Patent No. 4894863

PTL 5: Japanese Unexamined Patent Application Publication No. 2008-308717

PTL 6: Japanese Patent No. 4903915

SUMMARY OF THE INVENTION

However, in Patent Literature 1, although ductility is good, stretch flangeability is not taken into account. In Patent Literature 2, although stretch flangeability is good, ductility is not sufficient. In Patent Literatures 3, 4, and 5, although both high ductility and high stretch flangeability are achieved, deterioration of ductility at high strain rate is not taken into account. In Patent Literature 6, although a high elongation is achieved, deterioration of ductility at high strain rate is not taken into account.

In view of the circumstances described above, an object according to aspects of the present invention is to provide a steel sheet which has high strength, good ductility, and good stretch flangeability and in which deterioration of ductility under high strain rate is suppressed, a member, and methods for manufacturing the same.

The term "high strength" as used herein means that a tensile strength (TS) in a tensile test performed on a test specimen machined into a JIS No. 5 test specimen at a cross-head speed of 10 mm/min in accordance with JIS Z 2241 (2011) is 980 MPa or more.

The term "good ductility" means that a total elongation $El_1$ obtained by the above-described tensile test is 18% or more. The term "good stretch flangeability" means that a hole expansion test is performed on a 100 mm×100 mm test specimen three times in accordance with the Japan Iron and Steel Federation Standard JFS T 1001 with a 60° conical punch, and an average hole expansion ratio A is 20% or more. The expression "deterioration of ductility under high strain rate is suppressed" means that a test specimen machined into a JIS No. 5 test specimen is subjected to a high-speed tensile test in which the cross-head speed of the above-described tensile test is changed to 100 mm/min, and a ratio ($El_2/El_1$) of a measured value of $El_2$ (total elongation) in the high-speed tensile test to a measured value of $El_1$ (total elongation) in the normal tensile test described above is 85% or more.

The present inventors have conducted extensive studies in order to manufacture a high strength steel sheet which has good ductility (elongation) and stretch flangeability (hole expansion ratio) and in which deterioration of ductility under high strain rate is suppressed. In particular, studies for increasing the elongation and the hole expansion ratio were conducted by analyzing in detail a microstructural change formed in the thermal history during the manufacturing of a steel sheet. In the course of the studies conducted by the present inventors, a steel sheet obtained by appropriately adjusting the chemical composition was cooled from an annealing temperature at a predetermined cooling rate, subjected to a first holding at 380° C. or higher and 420° C. or lower to concentrate C in austenite by bainite transformation and Q&P (Quench and Partitioning) treatment, and subsequently subjected to a second holding under predetermined conditions at 440° C. or higher and 540° C. or lower. As a result, it was found that the above method provides a microstructure in which cementite particles are present in retained austenite and enables the manufacturing of a high strength steel sheet which has good ductility and stretch flangeability and in which deterioration of ductility under high strain rate is suppressed.

In general, in steel containing retained austenite in a large amount, a very high elongation is obtained by the TRIP effect of retained austenite in a normal tensile test at a low strain rate. However, strain-induced martensite formed through transformation of retained austenite by application of a strain contains a large amount of C dissolved therein and thus is very hard. It is known that, therefore, there is a large difference in hardness between microstructures, resulting in a decrease in the hole expansion ratio. It is also known that, in a tensile test at high strain rate, stable retained austenite is not transformed into martensite, resulting in a decrease in the elongation. However, in the composition and microstructure in accordance with aspects of the present invention, deterioration of stretch flangeability and ductility under high strain rate is suppressed while retained austenite is included to achieve good ductility. The details of this are not clear, but this is presumably because austenite in which C is excessively concentrated, the austenite being inevitably formed in the first holding, is partially precipitated as cementite particles during the second holding to thereby increase the hole expansion ratio. As described above, the retained austenite in which C is excessively concentrated, the retained austenite being inevitably formed by the first holding, is transformed into very hard martensite by a large strain during blanking and causes a decrease in the hole expansion ratio. Through the second holding in accordance with aspects of the present invention, cementite particles are precipitated in the austenite in which C is excessively concentrated, and the amount of austenite in which C is excessively concentrated decreases. Specifically, the amount of retained austenite having a relatively lower C concentration than the above-described retained austenite in which C is excessively concentrated increases. It is considered that this increases the amount of retained austenite that contributes to the elongation under high strain rate, and deterioration of ductility under high strain rate is suppressed.

Aspects of the present invention have been made on the basis of the findings described above. The summary of aspects of the present invention is as follows.

[1] A steel sheet including:

a chemical composition containing, by mass %,

C: 0.07% or more and 0.25% or less,

Si: 0.01% or more and 2.0% or less,

Al: 0.01% or more and 2.0% or less, a total of Si and Al: 0.7% or more and 2.5% or less, Mn: 1.9% or more and 3.2% or less, P: 0.1% or less, S: 0.02% or less, and N: 0.010% or less, with the balance being Fe and incidental impurities; and a steel microstructure including, in terms of area fraction, ferrite: 20% or more and 60% or less, a total of bainite and tempered martensite: 25% or more and 60% or less, retained austenite: 7% or more and 20% or less, fresh martensite: 8% or more and 40% or less, and the remainder: 5% or less, wherein cementite particles are present in the retained austenite, a ratio of an area fraction of the cementite particles in the retained austenite to an area fraction of the retained austenite is 5% or more and 25% or less, and the steel sheet has a tensile strength of 980 MPa or more.

[2] The steel sheet according to [1], wherein the cementite particles in the retained austenite have an average major axis of 30 nm or more and 400 nm or less.

[3] The steel sheet according to [1] or [2], wherein the chemical composition further contains, by mass %, at least one selected from Cr, V, Mo, Ni, and Cu in a total amount of 1.0% or less.

[4] The steel sheet according to any one of [1] to [3], wherein the chemical composition further contains, by mass %, at least one selected from Ti: 0.20% or less, and Nb: 0.20% or less.

[5] The steel sheet according to any one of [1] to [4], wherein the chemical composition further contains, by mass %, B: 0.005% or less.

[6] The steel sheet according to any one of [1] to [5], wherein the chemical composition further contains, by mass %, at least one selected from Ca: 0.005% or less, and REM: 0.005% or less.

[7] The steel sheet according to any one of [1] to [6], wherein the chemical composition further contains, by mass %, at least one selected from Sb: 0.05% or less, and Sn: 0.05% or less.

[8] The steel sheet according to any one of [1] to [7], further including a hot-dip galvanized layer or a hot-dip galvannealed layer on a surface of the steel sheet.

[9] A member obtained by subjecting the steel sheet according to any one of [1] to [8] to at least one of forming and welding.

[10] A method for manufacturing a steel sheet, the method including hot-rolling and cold-rolling a slab having the chemical composition according to any one of [1] and [3] to [7]; subsequently performing holding at an annealing temperature of 700° C. or higher and 950° C. or lower for 30 seconds or more and 1000 seconds or less; performing cooling from the annealing temperature to a cooling stop temperature of 150° C. or higher and 420° C. or lower at an average cooling rate of 10° C./s or higher; subsequently performing first holding under conditions in a temperature range of 380° C. or higher and 420° C. or lower for 10 seconds or more and 500 seconds or less; and further performing second holding under conditions of a temperature X° C. and a holding time Y second that satisfy formulae 1 to 3 below.

$$10000 \leq (273+X)\ (12+\log Y) \leq 11000 \quad \text{Formula 1}$$

$$440 \leq X \leq 540 \quad \text{Formula 2}$$

$$Y \leq 200 \quad \text{Formula 3}$$

The method for manufacturing a steel sheet according to [10], wherein an average heating rate from a holding temperature in the first holding to the temperature X° C. in the second holding is 3° C./s or higher.

The method for manufacturing a steel sheet according to [10], wherein an average heating rate from a holding temperature in the first holding to the temperature X° C. in the second holding is 10° C./s or higher.

[13] The method for manufacturing a steel sheet according to any one of [10] to [12], including, between the first holding and the second holding or after completion of the second holding, forming a hot-dip galvanized layer or a hot-dip galvannealed layer on a surface of the steel sheet.

[14] A method for manufacturing a member, the method including a step of subjecting a steel sheet manufactured by the method for manufacturing a steel sheet according to any one of [10] to [13] to at least one of forming and welding.

According to aspects of the present invention, there is provided a steel sheet which has high strength, good ductility, and good stretch flangeability and in which deterioration of ductility under high strain rate is suppressed. Manufacturing members by subjecting the steel sheet according to aspects of the present invention to forming, welding, and the like, and applying the members to, for example, automotive structural members reduce the weights of car bodies and thereby improve fuel efficiency; therefore, the steel sheet according to aspects of the present invention provides very high utility from an industrial viewpoint.

DETAILED DESCRIPTION OF EMBODIMENTS OF THE INVENTION

Embodiments of the present invention will be specifically described below. First, the chemical composition of steel according to aspects of the present invention will be described. Note that "%" used as the unit of the content of a component means "mass %.

C: 0.07% or more and 0.25% or less

C is an element that stabilizes austenite and is an element that is indispensable for obtaining retained austenite in which cementite particles are present. Furthermore, C is an element necessary for increasing steel sheet strength because C facilitates the formation of hard microstructures other than ferrite and necessary for improving the TS-EL balance by forming a multi-phase structure. When the C content is less than 0.078, the amount of ferrite becomes excessively large, and thus desired strength is not obtained. Therefore, the C content is 0.07% or more, preferably 0.08% or more, and more preferably 0.09% or more. On the other hand, when the C content exceeds 0.25%, the strength significantly increases, and the elongation decreases. Therefore, the C content is 0.25% or less, preferably 0.24% or less, and more preferably 0.23% or less.

Si: 0.01% or more and 2.0% or less

Si promotes concentration of C in austenite and inhibits the formation of a carbide such as cementite and promotes the formation of retained austenite. In view of the desiliconization cost in steelmaking, the Si content is 0.01% or more. On the other hand, when the Si content exceeds 2. 0%, the surface quality and weldability deteriorate, and thus the Si content is 2.0% or less. The Si content is preferably 1.8% or less.

Al: 0.01% or more and 2.0% or less

Al promotes concentration of C in austenite and inhibits the formation of a carbide such as cementite and promotes the formation of retained austenite. In view of the dealminization cost in steelmaking, the Al content is 0.01% or more. On the other hand, when the Al content exceeds 2.0%, the risk of occurrence of steel slab cracking is increased during continuous casting. Therefore, the Al content is 2.0% or less, and preferably 1.8% or less.

Total of Si and Al: 0.7% or more and 2.5% or less

Si and Al promote concentration of C in austenite and inhibit the formation of a carbide such as cementite. In order to obtain a sufficient amount of retained austenite, the total content of Si and Al is 0.7% or more, preferably 1.0% or more, and more preferably 1.3% or more. On the other hand, from the viewpoint of the manufacturing cost, the total content of Si and Al is 2.5% or less, preferably 2.2% or less, and more preferably 2.0% or less.

Mn: 1.9% or more and 3.2% or less

Mn is an element that is effective for strengthening steel because Mn improves hardenability and inhibits ferrite transformation and pearlite transformation during cooling after annealing. Mn is an austenite stabilizing element and also contributes to the formation of retained austenite. To obtain these effects, the Mn content is 1.9% or more, and preferably 2.0% or more. On the other hand, when the Mn content exceeds 3.28, the amount of ferrite decreases, the strength becomes excessively high, and the elongation decreases. Therefore, the Mn content is 3.2% or less, and preferably 3.1% or less.

P: 0.1% or less

P is an element that is effective for strengthening steel. However, when P is added in an excessive amount such that the P content exceeds 0.1%, embrittlement is caused by grain boundary segregation, and mechanical properties deteriorate. Therefore, the P content is 0.1% or less, preferably 0.05% or less, and more preferably 0.02% or less. Although the lower limit of the P content is not specified, currently, an industrially feasible lower limit of the P content is 0.002%.

S: 0.02% or less

S causes a deterioration of anti-crash properties and the occurrence of cracking along a metal flow in a weld zone as a result of the formation of inclusions such as MnS. Therefore, it is preferable to minimize the S content. In view of the manufacturing cost, the S content is 0.02% or less. The S content is preferably 0.01% or less. Although the lower limit of the S content is not specified, currently, an industrially feasible lower limit of the S content is 0.0002%.

N: 0.010% or less

N is an element that significantly deteriorates the aging resistance of steel, and it is preferable to minimize the N content. The deterioration of aging resistance becomes significant when the N content exceeds 0.010%. Therefore, the N content is 0.010% or less. Although the lower limit of the N content is not specified, currently, an industrially feasible lower limit of the N content is 0.0005%.

The steel sheet according to aspects of the present invention has a chemical composition that includes the above chemical composition as base components, with the balance including Fe (iron) and incidental impurities. Here, it is preferable that the steel sheet according to aspects of the present invention have a chemical composition that contains the above-described components as base components, with the balance being iron and incidental impurities. The steel sheet according to aspects of the present invention may contain components (optional elements) described below as appropriate depending on desired properties. Note that the lower limits of the following components are not particularly specified because the advantages according to aspects of the present invention are obtained as long as the contents of the components are equal to or less than the upper limits described below. When the contents of the following optional elements are less than the preferred lower limits described below, the elements are considered to be contained as incidental impurities.

At least one selected from Cr, V, Mo, Ni, and Cu, in total: 1.0% or less

Cr, V, Mo, Ni, and Cu inhibit pearlite transformation during cooling from an annealing temperature and effectively act on the formation of retained austenite. However, when the total content of at least one selected from Cr, V, Mo, Ni, and Cu exceeds 1.0%, the effect is saturated, and the cost may be increased. Therefore, when the steel sheet contains at least one of these elements, the total content of these elements is 1.0% or less. The total content of these elements is preferably 0.50% or less, and more preferably 0.35% or less. The lower limit of the total content is not particularly limited because the advantages according to aspects of the present invention are obtained at a total content of 1.0% or less. In order to more effectively obtain the effect of the formation of retained austenite due to Cr, V, Mo, Ni, and Cu, the total content is preferably 0.005% or more, and more preferably 0.02% or more.

At least one selected from Ti: 0.20% or less and Nb: 0.20% or less

Ti and Nb form carbides, nitrides and/or carbonitrides to exhibit a function of increasing the strength of steel through particle dispersion strengthening. However, when Ti and Nb are each contained in an amount of more than 0.20%, the strength excessively increases, and ductility decreases. Therefore, when the steel sheet contains at least one of Ti and Nb, the content of each of the elements is 0.20% or less. The total content of the elements is preferably 0.15% or less, and more preferably 0.08% or less. The lower limits of the Ti content and the Nb content are not particularly limited because the advantages according to aspects of the present invention are obtained as long as the Ti content and the Nb content are each 0.20% or less. In order to more effectively obtain the effect of particle dispersion strengthening due to Ti and Nb, the Ti content and the Nb content are each preferably 0.01% or more.

B: 0.005% or less

B has a function of increasing the strength by inhibiting the formation of ferrite from austenite grain boundaries as a result of being segregated at grain boundaries. However, when B is contained in an amount of more than 0.005%, B is precipitated as a boride, and the effect of sufficiently increasing the strength is not obtained. Therefore, when the steel sheet contains B, the B content is 0.005% or less. The B content is preferably 0.004% or less, and more preferably 0.003% or less. The lower limit of the B content is not particularly limited because the advantages according to aspects of the present invention are obtained as long as the B content is 0.005% or less. In order to more effectively obtain the effect of increasing the strength due to B, the B content is preferably 0.0003% or more.

At least one selected from Ca: 0.005% or less and REM: 0.005% or less

Ca and REM each have an effect of improving formability through morphological control of sulfides. However, an excessive addition may adversely affect the cleanliness.

Therefore, when the steel sheet contains at least one of Ca and REM, the content of each of the elements is 0.005% or less. The content of each of the elements is preferably 0.004% or less, and more preferably 0.003% or less. The lower limits of the Ca content and the REM content are not particularly limited because the advantages according to aspects of the present invention are obtained as long as the Ca content and the REM content are each 0.005% or less. In order to more effectively obtain the effect of improving formability due to Ca and REM, the Ca content and the REM content are each preferably 0.0001% or more.

At least one selected from Sb: 0.05% or less and Sn: 0.05% or less

Sb and Sn have a function of suppressing a decrease in the strength of steel by inhibiting, for example, decarbonization, denitridation, and deboronization. However, an excessive addition may deteriorate stretch flangeability. Therefore, when the steel sheet contains at least one of Sb and Sn, the content of each of the elements is 0.05% or less. The content of each of the elements is preferably 0.04% or less, and more preferably 0.03% or less. The lower limits of the Sb content and the Sn content are not particularly limited because the advantages according to aspects of the present invention are obtained as long as the Sb content and the Sn content are each 0.05% or less. In order to more effectively obtain the effect of suppressing a decrease in the strength due to Sb and Sn, the Sb content and the Sn content are each preferably 0.003% or more.

Next, the steel microstructure of the steel sheet will be described.

The steel sheet according to aspects of the present invention has a steel microstructure that includes, in terms of area fraction, ferrite: 20% or more and 60% or less, a total of bainite and tempered martensite: 25% or more and 60% or less, retained austenite: 7% or more and 20% or less, fresh martensite: 8% or more and 40% or less, and the remainder: 5% or less. In addition, cementite particles are present in retained austenite, and a ratio of an area fraction of the cementite particles in the retained austenite to an area fraction of the retained austenite is 5% or more and 25% or less.

Area fraction of ferrite: 20% or more and 60% or less

In order to ensure good ductility, 20% or more of ferrite, which is relatively soft, is necessary in terms of area fraction. The area fraction of ferrite is preferably 25% or more. On the other hand, in order to ensure strength, the area fraction of ferrite needs to be 60% or less. The area fraction of ferrite is preferably 55% or less.

Total area fraction of bainite and tempered martensite: 25% or more and 60% or less C is concentrated in austenite by bainite transformation and C partitioning from martensite to form retained austenite. Therefore, the total area fraction of bainite and tempered martensite is 25% or more, and preferably 27% or more. On the other hand, in order to obtain strength and to ensure good ductility, the area fraction is 60% or less, and preferably 55% or less. Note that it is sufficient that the total area fraction of bainite and tempered martensite is within the range described above, and either area fraction may be 0%.

Area fraction of fresh martensite: 8% or more and 40% or less

From the viewpoint of obtaining the strength in accordance with aspects of the present invention, the area fraction of fresh martensite needs to be 8% or more, and is preferably 9% or more. When the area fraction of fresh martensite exceeds 40%, the strength increases, and the elongation decreases. Therefore, the area fraction of fresh martensite is 40% or less, and preferably 35% or less.

The area fractions of ferrite, bainite, tempered martensite, and fresh martensite in accordance with aspects of the present invention are determined by a point counting method. A sheet-thickness cross section parallel to a rolling direction of the steel sheet is cut out, and heat treatment is performed at 200° C. for two hours. As a result, fresh martensite is slightly tempered. The sheet-thickness cross section (L cross section) of this sample is polished, then etched in 1 vol % nital, and observed with a scanning electron microscope (SEM) at a position 1/4 of the thickness from a surface of the steel sheet at a magnification of 1500 times for two fields of view. The area fractions can be determined by drawing a mesh on an image obtained by the observation, and performing point counting at 240 points in each field of view. Ferrite is a black microstructure, and bainite is a gray microstructure having a lath morphology. In each of tempered martensite, and fresh martensite after the heat treatment at 200° C. for two hours, a hierarchical structure including blocks and packets, and a precipitate are observed therein. Since the hierarchical structure and the precipitate of tempered martensite are apparently coarser than those of fresh martensite after the heat treatment at 200° C. for two hours, the area fraction of tempered martensite and the area fraction of fresh martensite can be determined in a clearly distinguishable manner. Retained austenite containing cementite is distinguishable from other microstructures because a hierarchical structure is not observed in the phase under the sample preparation conditions and the observation conditions described above.

Area fraction of retained austenite: 7% or more and 20% or less

In order to ensure good ductility, the TRIP effect of retained austenite is utilized. In order to increase the elongation by the TRIP effect, the area fraction of retained austenite needs to be 7% or more. The area fraction of retained austenite is preferably 8% or more, and more preferably 9% or more. From the viewpoint of obtaining the strength in accordance with aspects of the present invention, the area fraction of retained austenite is 20% or less, preferably 19% or less, and more preferably 18% or less. In accordance with aspects of the present invention, a volume fraction of retained austenite determined by a measuring method described below is regarded as the area fraction of retained austenite. The volume fraction can be determined by polishing the steel sheet in a thickness direction thereof until a surface at a position of ¼ of the thickness is exposed, and subjecting the surface at the position of ¼ of the thickness to measurement of the X-ray diffraction intensity. Mo-Ka radiation is used as the incident X-ray, the intensity ratios are determined with respect to all combinations of integral intensities of peaks of {111}, {200}, {220}, and {311} planes of retained austenite and {110}, {200}, and {211} planes of ferrite, and the average of these is defined as the volume fraction of retained austenite.

Ratio of area fraction of cementite particles in retained austenite to area fraction of retained austenite (Area fraction of cementite particles in retained austenite/Area fraction of retained austenite): 5% or more and 25% or less Cementite particles are present in retained austenite. The expression "cementite particles are present in retained austenite" as used herein is defined as a state where cementite has at least a portion of the interface with retained austenite. Accordingly, other portions may have the interface with other phases such as ferrite, bainite, tempered martensite, and fresh martensite as long as cementite has the interface with retained austenite in a portion. When retained austenite contains cementite particles, a portion having an excessively high solute C concentration in retained austenite, which decreases the hole expansion ratio, can be reduced to increase the hole expansion ratio. This effect is obtained when a ratio of the area fraction of cementite particles in retained austenite to the area fraction of retained austenite is 5% or more. On the other hand, when the ratio exceeds 25%, stability of retained austenite significantly decreases, resulting in a decrease in the elongation. Therefore, the ratio is 5% or more, and the ratio is 25% or less.

In accordance with aspects of the present invention, the ratio of the area fraction of cementite particles in retained austenite to the area fraction of retained austenite is determined by transmission electron microscopy on an observation surface, which is a surface at a position of 1/4 of the thickness of the steel sheet. Specifically, the ratio is determined by observing five retained austenite grains, and using a point counting method. A sample for the transmission electron microscopy is prepared by electropolishing. The use of a transmission electron microscope enables retained austenite to be easily found from information of an electron diffraction pattern, stacking faults, or the like. A bright-field image of retained austenite is captured at a magnification of 50000 times so as to include the surrounding interface. The determination is performed by drawing a mesh on the obtained image, performing point counting at 240 points in each field of view, and dividing the number of intersection points corresponding to cementite particles by the number of intersection points corresponding to retained austenite. The mesh has a grid-like shape in which length×width is 0.1 μm×0.1 μm with respect to the image. Electron diffraction is used to identify cementite particles.

Cementite particles are also present in tempered martensite. However, cementite particles present in retained austenite and cementite particles present in tempered martensite are easily distinguishable from each other from a selected area electron diffraction pattern or a substructure.

Average major axis of cementite particles in retained austenite: 30 nm or more and 400 nm or less (preferred range)

In order to ensure a high hole expansion ratio, cementite particles in retained austenite preferably have an average major axis of 30 nm or more. When the average major axis is 30 nm or more, fine voids are less likely to be formed during shearing, and a high hole expansion ratio is easily achieved. When cementite particles in retained austenite have an average major axis of 400 nm or less, the C concentration in retained austenite near cementite particles is less likely to decrease, stability of retained austenite increases, and a high elongation is easily achieved. Thus, in order to ensure a better elongation, the average major axis of cementite particles in retained austenite is preferably 400 nm or less. The average major axis of cementite particles is determined by measuring the maximum lengths of 10 cementite particles from an image of cementite particles present in retained austenite, the image being captured by a transmission electron microscope, and calculating the average of the maximum lengths.

Remainder: 5% or less

The remainder other than ferrite, bainite, tempered martensite, fresh martensite, and retained austenite is 5% or less, and preferably 4% or less in order to obtain the advantages according to aspects of the present invention. The remaining microstructure can include, for example, carbides that remain undissolved in annealing, precipitates due to alloying elements, and pearlite. Note that cementite particles present in retained austenite are included in the remainder.

The steel sheet according to aspects of the present invention may have a hot-dip galvanized layer or a hot-dip galvannealed layer on a surface thereof.

The sheet thickness of the steel sheet according to aspects of the present invention is preferably 0.2 mm or more and 3.2 mm or less from the viewpoint of effectively obtaining the advantages according to aspects of the present invention.

Next, an embodiment of a method for manufacturing a steel sheet according to aspects of the present invention will be described.

An embodiment of a method for manufacturing a steel sheet according to aspects of the present invention includes, for example, holding a steel sheet obtained by hot-rolling and cold-rolling a slab having the chemical composition described above at an annealing temperature of 700° C. or higher and 950° C. or lower for 30 seconds or more and 1000 seconds or less, performing cooling from the annealing temperature to a cooling stop temperature of 150° C. or higher and 420° C. or lower at an average cooling rate of 10° C./s or higher, subsequently performing first holding under conditions in a temperature range of 380° C. or higher and 420° C. or lower for 10 seconds or more and 500 seconds or less, and further performing second holding under conditions of a temperature X° C. and a holding time Y second that satisfy formulae 1 to 3 below.

Formula1: $10000 \leq (273+X)(12+\log Y) \leq 11000$

Formula2: $440 \leq X \leq 540$

Formula3: $Y \leq 200$

An embodiment of the method for manufacturing a steel sheet according to aspects of the present invention will be described in detail below. Note that temperatures described below in heating or cooling of a slab (steel material), a steel sheet, or the like refer to temperatures of a surface of the slab (steel material), the steel sheet, or the like unless otherwise stated.

Steel having the chemical composition described above is obtained by steelmaking through a publicly known common process and is then formed into a slab through blooming or continuous casting, and the slab is hot-rolled to obtain a hot coil. In hot rolling, preferably, the slab is heated to a temperature in the range of 1100° C. to 1300° C., is hot-rolled at a final finishing temperature of 850° C. or higher, and is coiled at a temperature in the range of 400° C. to 750° C. When the coiling temperature exceeds 750° C., a carbide such as cementite in the hot-rolled steel sheet is coarsened and does not melt completely during soaking in short-time annealing after cold rolling, and thus, necessary strength may not be obtained. Subsequently, the hot-rolled steel sheet is subjected to preliminary treatment, such as pickling or degreasing, by a publicly known common method and is then cold-rolled. In cold rolling, cold rolling is preferably performed at a cold rolling reduction of 30% or more. At a low cold rolling reduction, recrystallization of ferrite is not promoted, and non-recrystallized ferrite remains, which may result in the deterioration of ductility (elongation) and flangeability.

Holding at annealing temperature of 700° C. or higher and 950° C. or lower for 30 seconds or more and 1000 seconds or less In accordance with aspects of the present invention, annealing (holding) is performed in a temperature range of 700° C. or higher and 950° C. or lower, specifically in an austenite single-phase region or a two-phase region of austenite and ferrite, for 30 seconds or more and 1000 seconds or less. When the annealing temperature is lower than 700° C. or the holding (annealing) time is less than 30 seconds, recrystallization of ferrite or reverse transformation to austenite does not occur sufficiently, the desired microstructure is not formed, which may result in insufficient strength. On the other hand, when the annealing temperature exceeds 950° C., austenite grains are significantly grown, which may cause a decrease in the nucleation sites for ferrite transformation that is caused by subsequent cooling. When the holding (annealing) time exceeds 1000 seconds, austenite is coarsened, and an increase in the cost due to high energy consumption may be caused. The annealing temperature is preferably 750° C. or higher. The annealing temperature is preferably 900° C. or lower. The holding time at the annealing temperature is preferably 40 seconds or more. The holding time at the annealing temperature is preferably 500 seconds or less.

Cooling from annealing temperature to cooling stop temperature of 150° C. or higher and 420° C. or lower at average cooling rate of 10° C./s or higher When the average cooling rate from the annealing temperature is lower than 10° C./s, a large amount of ferrite is formed, and sufficient strength is not obtained. Therefore, the average cooling rate from the annealing temperature is 10° C./s or higher. The average cooling rate is preferably 15° C./s or higher. The upper limit of the average cooling rate is not particularly limited but is preferably 200° C./s or lower from the viewpoint of reducing the cost of equipment investment.

When the cooling stop temperature is higher than 420° C., the driving force for bainite transformation decreases, and thus a sufficient amount of retained austenite is not obtained. On the other hand, when the cooling stop temperature is lower than 150° C., martensite transformation excessively proceeds, the amount of non-transformed austenite decreases, and a sufficient amount of retained austenite is not obtained even when the subsequent first holding is appropriately performed. Therefore, the cooling stop temperature is 150° C. or higher and 420° C. or lower.

First holding under conditions in temperature range of 380° C. or higher and 420° C. or lower for 10 seconds or more and 500 seconds or less Holding in this temperature range is one of the important requirements in accordance with aspects of the present invention. When the holding temperature is lower than 380° C., the holding temperature exceeds 420° C., or the holding time is less than 10 seconds, concentration of C in non-transformed austenite by bainite transformation or partitioning of C from martensite to non-transformed austenite is not promoted. Therefore, a sufficient amount of retained austenite is not obtained, and a high elongation is not achieved. When the holding time exceeds 500 seconds, pearlite transformation occurs, the area fraction of retained austenite decreases, and thus a high elongation is not achieved.

Second holding under conditions of temperature X° C. and holding time Y second that satisfy formulae 1 to 3 below $$10000 \leq (273+X)\ (12+\log Y) \leq 11000 \qquad \text{Formula 1}$$

$$440 \leq X \leq 540 \qquad \text{Formula 2}$$

$$Y \leq 200 \qquad \text{Formula 3}$$

Holding in a temperature range that satisfies the above conditions is also one of the important requirements in accordance with aspects of the present invention. Through the second holding, cementite particles are precipitated in austenite which is formed in the first holding and in which C is excessively concentrated. This enables the hole expansion ratio to be increased and enables a decrease in the elongation under high strain rate to be inhibited. Such precipitation of cementite particles from austenite in which C is excessively concentrated has hardly been studied to date. As a result of extensive studies on this precipitation phenomenon, it was found that when the parameter "(273+X) (12+logY)" in the formula 1, which depends on the temperature and the time, satisfies 10000 or more and 11000 or less, the area fraction of retained austenite becomes 7% or more, and cementite particles can be appropriately made present in retained austenite. "(273+X) (12+logY)" is a parameter in which the constant is set to 12 in the tempering parameter of martensitic steel, and depends on the temperature X° C. and the holding time Y second in the second holding. In the case of X <440 or (273+X) (12+logY) <10000, the precipitation of cementite particles does not sufficiently occur, retained austenite in which C is excessively concentrated remains, resulting in a decrease in the hole expansion ratio and a decrease in the elongation under high strain rate. On the other hand, in the case of 540<X or 11000< (273+X) (12+logY), a high elongation is not achieved because cementite particles are excessively precipitated, or the amount of retained austenite is significantly decreased by pearlite transformation. In the case of Y >200, the elongation is decreased by coarsening of precipitated cementite or the occurrence of pearlite transformation. Therefore, the second holding needs to be performed under conditions of a temperature X° C. and a holding time Y second that satisfy the formulae 1 to 3 above.

Average heating rate from holding temperature in first holding to temperature X° C. in second holding is 3° C./s or higher (preferred range)

When an average heating rate from a holding temperature in the first holding to the temperature X° C. in the second holding is 3° C./s or higher, cementite particles tend to be uniformly precipitated, and a high elongation is easily achieved. Therefore, the average heating rate is preferably 3° C./s or higher. The average heating rate is more preferably 10° C./s or higher. The average heating rate is still more preferably 20° C./s or higher. The upper limit of the average heating rate is not particularly limited but is preferably 200° C./s or lower from the viewpoint of reducing the cost of equipment investment.

Formation of hot-dip galvanized layer or hot-dip galvannealed layer

A hot-dip galvanized layer or a hot-dip galvannealed layer may be formed on a surface of the steel sheet between the first holding and the second holding (after completion of the first holding and before start of the second holding) or after completion of the second holding. In the case where a hot-dip galvanized layer is formed on a surface of the steel sheet, between the first holding and the second holding, or after completion of the second holding, the steel sheet is immersed in a plating bath at a normal bath temperature and subjected to coating treatment, and the coating weight is adjusted by, for example, gas wiping. It is not necessary to particularly limit the conditions for the plating bath temperature, but the plating bath temperature is preferably in the range of 450° C. to 500° C. In the case where a hot-dip galvannealed layer is formed on a surface of the steel sheet, after a hot-dip galvanized layer is formed, the hot-dip galvanized layer is subjected to alloying treatment to form a hot-dip galvannealed layer.

For the purpose of improving corrosion resistance in practical use, a surface of the steel sheet may be subjected to hot-dip galvanizing treatment, as described above. In such a case, in order to ensure press formability, spot weldability, and adhesion of paints, hot-dip galvannealing is often used, in which heat treatment is performed after coating to diffuse Fe of the steel sheet into the coated layer.

In a series of heat treatment in the manufacturing method according to aspects of the present invention, the holding temperature need not be necessarily constant as long as the temperature is within the range described above, and even when the cooling rate is changed during cooling, the gist of aspects of the present invention is not impaired as long as the cooling rate is within the specified range. Furthermore, the steel sheet may be subjected to heat treatment in any equipment as long as only the thermal history is satisfied. In addition, it is also included in the scope of the present invention that the steel sheet according to aspects of the present invention is subjected to temper rolling after heat treatment for the purpose of shape correction.

Next, a member according to aspects of the present invention and a method for manufacturing the same will be described.

A member according to aspects of the present invention is obtained by subjecting the steel sheet according to aspects of the present invention to at least one of forming and welding. A method for manufacturing a member according to aspects of the present invention includes a step of subjecting a steel sheet manufactured by the method for manufacturing a steel sheet according to aspects of the present invention to at least one of forming and welding.

The steel sheet according to aspects of the present invention has high strength, good ductility, and good stretch flangeability and is less likely to be subjected to deterioration of ductility under high strain rate. Therefore, a member obtained using the steel sheet according to aspects of the present invention has high strength, in which cracking and necking occur rarely in a stretched portion and a stretch flange portion. Thus, the member according to aspects of the present invention can be suitably used for, for example, a part obtained by forming a steel sheet into a complicated shape. The member according to aspects of the present invention can be suitably used for, for example, an automotive part.

For the forming, a common forming method, such as press forming, can be employed without limitation. For the welding, common welding, such as spot welding or arc welding, can be employed without limitation.

EXAMPLES

Aspects of the present invention will be specifically described with reference to Examples. The scope of the present invention is not limited by Examples below.

Example 1

Steels having the chemical compositions shown in Table 1 were each obtained by steelmaking in a vacuum melting furnace, heated and held at a temperature of 1250° C. for one hour, and rolled to a sheet thickness of 4.0 mm at a finish rolling temperature of 900° C. or higher. The steel sheets after hot rolling were held at 500° C. for one hour, and then subjected to furnace cooling. Note that the treatment of holding a steel sheet after hot rolling at 500° C. for one hour and then subjecting the steel sheet to furnace cooling is treatment equivalent to treatment of coiling a steel sheet after hot rolling at 500° C. Subsequently, the resulting hot-rolled steel sheets were each pickled and then cold-rolled to a sheet thickness of 1.4 mm. Subsequently, the cold-rolled steel sheets after cold rolling were treated under the conditions shown in Table 2 to manufacture steel sheets.

TABLE 1

| Steel type | Chemical composition (mass %) | | | | | | | | | | |
|---|---|---|---|---|---|---|---|---|---|---|---|
| | C | Si | Al | *1 | Mn | P | S | N | Cr | V | Mo |
| A | 0.192 | 1.54 | 0.03 | 1.57 | 2.31 | 0.009 | 0.0008 | 0.0028 | — | — | — |
| B | 0.128 | 1.51 | 0.06 | 1.57 | 2.68 | 0.011 | 0.0015 | 0.0022 | — | — | — |
| C | 0.085 | 1.48 | 0.04 | 1.52 | 2.62 | 0.011 | 0.0014 | 0.0028 | — | — | — |
| D | 0.231 | 1.37 | 0.25 | 1.62 | 2.05 | 0.010 | 0.0008 | 0.0036 | — | — | — |
| E | 0.062 | 1.51 | 0.04 | 1.55 | 2.23 | 0.008 | 0.0011 | 0.0031 | — | — | — |
| F | 0.274 | 1.25 | 0.04 | 1.29 | 2.11 | 0.009 | 0.0013 | 0.0027 | — | — | — |
| G | 0.185 | 1.84 | 0.04 | 1.88 | 2.08 | 0.011 | 0.0009 | 0.0031 | — | — | — |
| H | 0.201 | 0.72 | 1.69 | 2.41 | 2.55 | 0.009 | 0.0012 | 0.0033 | — | — | — |
| I | 0.210 | 0.84 | 0.19 | 1.03 | 2.44 | 0.011 | 0.0008 | 0.0032 | — | — | — |
| J | 0.188 | 0.61 | 0.03 | 0.64 | 2.18 | 0.012 | 0.0013 | 0.0035 | — | — | — |
| K | 0.211 | 1.72 | 0.03 | 1.75 | 1.95 | 0.011 | 0.0021 | 0.0036 | — | — | — |
| L | 0.188 | 1.50 | 0.03 | 1.53 | 1.79 | 0.009 | 0.0011 | 0.0033 | — | — | — |
| M | 0.181 | 0.75 | 0.76 | 1.51 | 3.02 | 0.008 | 0.0008 | 0.0031 | — | — | — |
| N | 0.200 | 1.43 | 0.03 | 1.46 | 3.35 | 0.010 | 0.0011 | 0.0033 | — | — | — |
| O | 0.205 | 1.45 | 0.04 | 1.49 | 2.11 | 0.008 | 0.0010 | 0.0031 | 0.08 | — | — |
| P | 0.177 | 1.55 | 0.03 | 1.58 | 2.33 | 0.011 | 0.0009 | 0.0026 | — | 0.05 | — |
| Q | 0.185 | 1.51 | 0.03 | 1.54 | 2.20 | 0.009 | 0.0009 | 0.0025 | — | — | 0.20 |
| R | 0.131 | 1.50 | 0.04 | 1.54 | 2.71 | 0.009 | 0.0010 | 0.0021 | — | — | — |
| S | 0.174 | 1.52 | 0.03 | 1.55 | 2.14 | 0.011 | 0.0010 | 0.0034 | — | — | — |
| T | 0.180 | 1.53 | 0.04 | 1.57 | 2.26 | 0.009 | 0.0008 | 0.0022 | — | — | — |
| U | 0.178 | 1.56 | 0.03 | 1.59 | 2.18 | 0.011 | 0.0010 | 0.0033 | — | — | — |
| V | 0.185 | 1.51 | 0.04 | 1.55 | 2.20 | 0.012 | 0.0013 | 0.0033 | — | — | — |
| W | 0.210 | 1.48 | 0.03 | 1.51 | 2.11 | 0.012 | 0.0032 | 0.0035 | — | — | — |
| X | 0.185 | 1.54 | 0.04 | 1.58 | 2.31 | 0.011 | 0.0029 | 0.0033 | — | — | — |
| Y | 0.180 | 1.38 | 0.05 | 1.43 | 2.10 | 0.009 | 0.0014 | 0.0035 | — | — | 0.12 |
| Z | 0.211 | 1.46 | 0.04 | 1.50 | 2.25 | 0.010 | 0.0016 | 0.0041 | — | 0.02 | 0.10 |

| Steel type | Chemical composition (mass %) | | | | | | | | | Remarks |
|---|---|---|---|---|---|---|---|---|---|---|
| | Ni | Cu | Nb | Ti | B | Ca | REM | Sb | Sn | |
| A | — | — | — | — | — | — | — | — | — | Suitable steel |
| B | — | — | — | — | — | — | — | — | — | Suitable steel |
| C | — | — | — | — | — | — | — | — | — | Suitable steel |
| D | — | — | — | — | — | — | — | — | — | Suitable steel |
| E | — | — | — | — | — | — | — | — | — | Comparative steel |
| F | — | — | — | — | — | — | — | — | — | Comparative steel |
| G | — | — | — | — | — | — | — | — | — | Suitable steel |
| H | — | — | — | — | — | — | — | — | — | Suitable steel |
| I | — | — | — | — | — | — | — | — | — | Suitable steel |
| J | — | — | — | — | — | — | — | — | — | Comparative steel |
| K | — | — | — | — | — | — | — | — | — | Suitable steel |
| L | — | — | — | — | — | — | — | — | — | Comparative steel |
| M | — | — | — | — | — | — | — | — | — | Suitable steel |
| N | — | — | — | — | — | — | — | — | — | Comparative steel |
| O | — | — | — | — | — | — | — | — | — | Suitable steel |
| P | — | — | — | — | — | — | — | — | — | Suitable steel |
| Q | — | — | — | — | — | — | — | — | — | Suitable steel |
| R | 0.1 | 0.05 | — | — | — | — | — | — | — | Suitable steel |
| S | — | — | 0.03 | 0.02 | — | — | — | — | — | Suitable steel |
| T | — | — | — | 0.02 | 0.0021 | — | — | — | — | Suitable steel |
| U | — | — | — | — | — | 0.002 | — | — | — | Suitable steel |
| V | — | — | — | — | — | — | 0.002 | — | — | Suitable steel |
| W | — | — | — | — | — | — | — | 0.01 | — | Suitable steel |
| X | — | — | — | — | — | — | — | — | 0.01 | Suitable steel |
| Y | — | — | 0.01 | 0.02 | 0.0015 | — | — | — | — | Suitable steel |
| Z | — | — | — | 0.02 | 0.0020 | — | — | 0.01 | — | Suitable steel |

*1: Total of Si and Al

The balance other than the above is Fe and incidental impurities.

TABLE 2

| No. | Steel type | Annealing temperature (° C.) | Holding time (s) | *1 (° C./s) | *2 (° C.) | First holding: Holding temperature (° C.) | First holding: Holding time (s) | Second holding: Holding temperature X (° C.) | Second holding: Holding time Y (s) | *3 | *4 (° C./s) | Type | Coating treatment | Remarks |
|---|---|---|---|---|---|---|---|---|---|---|---|---|---|---|
| 1 | A | 810 | 95 | 28 | 210 | 400 | 40 | 490 | 25 | 10223 | 30 | GA | *5 | Inventive Example |
| 2 | A | 685 | 95 | 25 | 250 | 400 | 40 | 490 | 25 | 10223 | 30 | GA | *5 | Comparative Example |
| 3 | A | 830 | 15 | 25 | 250 | 400 | 40 | 490 | 25 | 10223 | 30 | CR | — | Comparative Example |
| 4 | A | 790 | 95 | 4 | 200 | 420 | 50 | 510 | 25 | 10491 | 20 | CR | — | Comparative Example |
| 5 | A | 810 | 120 | 25 | 200 | 410 | 5 | 500 | 30 | 10418 | 30 | CR | — | Comparative Example |
| 6 | A | 800 | 100 | 20 | 200 | 400 | 30 | 530 | 300 | 11625 | 15 | CR | — | Comparative Example |
| 7 | A | 810 | 100 | 30 | 50 | 400 | 30 | 500 | 30 | 10418 | 30 | CR | — | Comparative Example |
| 8 | A | 820 | 100 | 30 | 470 | 470 | 30 | 530 | 20 | 10681 | 30 | CR | — | Comparative Example |
| 9 | B | 820 | 100 | 26 | 250 | 390 | 70 | 490 | 30 | 10283 | 30 | GA | *5 | Inventive Example |
| 10 | B | 810 | 150 | 20 | 300 | 500 | 100 | 500 | 40 | 10514 | 30 | CR | — | Comparative Example |
| 11 | B | 810 | 150 | 20 | 200 | 415 | 1500 | 530 | 40 | 10922 | 30 | CR | — | Comparative Example |
| 12 | B | 820 | 100 | 30 | 200 | 400 | 60 | 550 | 15 | 10844 | 15 | CR | — | Comparative Example |
| 13 | B | 820 | 150 | 20 | 250 | 400 | 90 | 400 | 30 | 9070 | 30 | CR | — | Comparative Example |
| 14 | B | 820 | 150 | 20 | 350 | 330 | 50 | 500 | 30 | 10418 | 30 | CR | — | Comparative Example |
| 15 | B | 810 | 150 | 25 | 200 | 400 | 30 | 530 | 120 | 11306 | 30 | CR | — | Comparative Example |
| 16 | B | 810 | 150 | 30 | 200 | 400 | 40 | 450 | 15 | 9526 | 15 | GA | *5 | Comparative Example |
| 17 | C | 800 | 150 | 30 | 250 | 410 | 100 | 485 | 25 | 10156 | 15 | GI | *6 | Inventive Example |
| 18 | D | 790 | 90 | 20 | 200 | 410 | 50 | 485 | 25 | 10156 | 15 | GI | *6 | Inventive Example |
| 19 | E | 800 | 90 | 25 | 350 | 400 | 50 | 500 | 20 | 10282 | 15 | CR | — | Comparative Example |
| 20 | F | 810 | 100 | 25 | 250 | 400 | 60 | 500 | 25 | 10357 | 50 | CR | — | Comparative Example |
| 21 | G | 830 | 100 | 25 | 250 | 400 | 60 | 490 | 100 | 10682 | 50 | GA | *5 | Inventive Example |
| 22 | H | 850 | 100 | 15 | 250 | 400 | 100 | 480 | 25 | 10089 | 50 | CR | — | Inventive Example |
| 23 | I | 790 | 150 | 20 | 200 | 410 | 60 | 480 | 30 | 10148 | 30 | CR | — | Inventive Example |
| 24 | J | 790 | 150 | 30 | 200 | 410 | 60 | 480 | 30 | 10148 | 15 | CR | — | Comparative Example |
| 25 | K | 820 | 90 | 50 | 300 | 400 | 30 | 490 | 30 | 10283 | 30 | CR | — | Inventive Example |
| 26 | L | 820 | 100 | 30 | 250 | 400 | 60 | 530 | 20 | 10681 | 15 | CR | — | Comparative Example |
| 27 | M | 820 | 150 | 25 | 200 | 400 | 120 | 475 | 30 | 10081 | 50 | CR | — | Inventive Example |
| 28 | N | 800 | 150 | 25 | 250 | 400 | 60 | 500 | 30 | 10418 | 50 | CR | — | Comparative Example |
| 29 | O | 800 | 100 | 25 | 250 | 400 | 50 | 520 | 20 | 10548 | 30 | CR | — | Inventive Example |
| 30 | P | 820 | 100 | 25 | 250 | 410 | 100 | 500 | 45 | 10554 | 5 | CR | — | Inventive Example |
| 31 | Q | 790 | 100 | 30 | 200 | 400 | 60 | 520 | 20 | 10548 | 30 | CR | — | Inventive Example |
| 32 | R | 800 | 100 | 25 | 250 | 400 | 60 | 510 | 50 | 10726 | 15 | CR | — | Inventive Example |
| 33 | S | 800 | 100 | 25 | 200 | 400 | 50 | 480 | 30 | 10148 | 15 | CR | — | Inventive Example |
| 34 | T | 800 | 100 | 25 | 200 | 400 | 50 | 510 | 30 | 10553 | 30 | CR | — | Inventive Example |
| 35 | U | 800 | 100 | 25 | 200 | 410 | 100 | 510 | 25 | 10491 | 50 | CR | — | Inventive Example |
| 36 | V | 800 | 100 | 20 | 200 | 390 | 100 | 510 | 25 | 10491 | 50 | GI | *6 | Inventive Example |
| 37 | W | 800 | 100 | 20 | 200 | 400 | 100 | 510 | 25 | 10491 | 30 | GA | *6 | Inventive Example |
| 38 | X | 810 | 100 | 30 | 200 | 400 | 45 | 500 | 30 | 10418 | 25 | GI | *6 | Inventive Example |
| 39 | Y | 820 | 180 | 30 | 210 | 400 | 45 | 500 | 30 | 10418 | 6 | GA | *5 | Inventive Example |
| 40 | Z | 815 | 180 | 30 | 210 | 400 | 45 | 500 | 30 | 10418 | 6 | GA | *5 | Inventive Example |
| 41 | A | 810 | 180 | 30 | 200 | 400 | 45 | 500 | 30 | 10418 | 6 | GA | *5 | Inventive Example |
| 42 | A | 810 | 180 | 30 | 200 | 400 | 45 | 500 | 30 | 10418 | 2 | GA | *5 | Inventive Example |

*1: Average cooling rate from annealing temperature to cooling stop temperature
*2: Cooling stop temperature
*3: (273 + X)(12 + logY)
*4: Average heating rate from holding temperature in first holding to temperature X° C. in second holding
*5: Coating treatment between first holding and second holding
*6: Coating treatment after completion of second holding
CR:: Cold-rolled steel sheet, GI: Hot-dip galvanized steel sheet, GA: Hot-dip galvannealed steel sheet <Evaluation of Microstructure>

(Area fractions of ferrite, bainite, tempered martensite, and fresh martensite)

The area fractions of ferrite, bainite, tempered martensite, and fresh martensite were determined by a point counting method. From each of the steel sheets manufactured by the method described above, a sheet-thickness cross section parallel to the rolling direction of the steel sheet was cut out, and heat treatment was performed at 200° C. for two hours. As a result, fresh martensite was slightly tempered. The sheet-thickness cross section (L cross section) of the resulting sample was polished, then etched in 1 vol % nital, and observed with a scanning electron microscope (SEM) at a position 1/4 of the thickness from the surface of the steel sheet at a magnification of 1500 times for two fields of view. The area fractions were determined by drawing a mesh on an image obtained by the observation, and performing point counting at 240 points in each field of view. Ferrite is a black microstructure, and bainite is a gray microstructure having a lath morphology. In each of tempered martensite, and fresh martensite after the heat treatment at 200° C. for two hours, a hierarchical structure including blocks and packets, and a precipitate were observed therein. Since the hierarchical structure and the precipitate of tempered martensite are apparently coarser than those of fresh martensite after the heat treatment at 200° C. for two hours, the area fraction of tempered martensite and the area fraction of fresh martensite can be determined in a clearly distinguishable manner. Retained austenite containing cementite is distinguishable from other microstructures because a hierarchical structure is not observed in the phase under the sample preparation conditions and the observation conditions described above.

(Area fraction of retained austenite)

A volume fraction of retained austenite determined by a measuring method described below was regarded as the area fraction of retained austenite. The volume fraction of retained austenite was determined by polishing each of the steel sheets manufactured by the method described above in a thickness direction thereof until a surface at a position of 1/4 of the thickness was exposed, and subjecting the surface at the position of ¼ of the thickness to measurement of the X-ray diffraction intensity. Mo-Kα radiation was used as the incident X-ray, the intensity ratios were determined with respect to all combinations of integral intensities of peaks of {111}, {200}, {220}, and {311} planes of retained austenite and {110}, {200}, and {211} planes of ferrite, and the average of these was defined as the volume fraction of retained austenite.

(Area fraction of remainder other than ferrite, bainite, tempered martensite, fresh martensite, and retained austenite)

The area fraction of the remainder was calculated by subtracting each of the area fractions of ferrite, bainite, tempered martensite, fresh martensite, and retained austenite calculated by the methods described above from 100%.

(Ratio of area fraction of cementite particles in retained austenite to area fraction of retained austenite)

Five retained austenite grains were observed by transmission electron microscopy on an observation surface, which was a surface at a position of ¼ of the thickness of each of the steel sheets manufactured by the method described above. The ratio of the area fraction of cementite particles in retained austenite to the area fraction of retained austenite was determined by the point counting method. A sample for the transmission electron microscopy was prepared by electropolishing. A bright-field image of retained austenite was captured at a magnification of 50000 times so as to include the surrounding interface. A mesh was drawn on the obtained image, point counting was performed at 240 points in each field of view, and the number of intersection points corresponding to cementite particles was divided by the number of intersection points corresponding to retained austenite to determine the area fraction of cementite particles. The mesh had a grid-like shape in which length×width was 0.1 μm×0.1 μm with respect to the image. Electron diffraction was used to identify cementite particles.

(Average major axis of cementite particles in retained austenite)

The average major axis of cementite particles in retained austenite was determined by measuring the maximum lengths of 10 cementite particles from the above-described image of cementite particles present in retained austenite, the image being captured by a transmission electron microscope, and calculating the average of the maximum lengths.

Note that, for samples in which the area fraction of retained austenite was less than 7%, the measurements of the area fraction and the average major axis of cementite particles with the transmission electron microscope were not performed.

<Tensile Properties>

A tensile test was performed to measure TS (tensile strength) and $El_1$ (total elongation). A test specimen machined into a JIS No. 5 test specimen was subjected to the tensile test at a cross-head speed of 10 mm/min in accordance with JIS Z 2241 (2011). In accordance with aspects of the present invention, in the case where the tensile strength was 980 MPa or more, and $El_1 \geq 18$ (%), ductility was evaluated to be good.

<Stretch Flangeability>

Stretch flangeability was evaluated by a hole expansion test. A 100 mm×100 mm test specimen was taken and subjected to a hole expansion test three times in accordance with the Japan Iron and Steel Federation Standard JFS T 1001 with a 60° conical punch, and an average hole expansion ratio λ (%) was determined. In accordance with aspects of the present invention, in the case of A >20 (%), stretch flangeability was evaluated to be good.

<Elongation at High Strain Rate>

A high-speed tensile test was performed to measure $El_2$ (total elongation). A test specimen machined into a JIS No. 5 test specimen was subjected to the high-speed tensile test in which the cross-head speed of the above-described tensile test was changed to 100 mm/min. In accordance with aspects of the present invention, the case where a ratio of a measured value of $El_2$ (total elongation) in the high-speed tensile test to a measured value of $El_1$ (total elongation) in the normal tensile test described above was 85% or more was evaluated to be good. That is, a ratio $El_2/El_1$ of 0.85 or more was evaluated that the deterioration of ductility under high strain rate was suppressed.

TABLE 3

| | | Area fraction of steel sheet microstructure | | | | | | | Tensile properties | | | | | |
|---|---|---|---|---|---|---|---|---|---|---|---|---|---|---|
| No. | Steel type | *1 (%) | *2 (%) | *3 (%) | *4 (%) | *5 (%) | *6 (%) | *7 (nm) | TS (MPa) | $El_1$ (%) | λ (%) | $El_2$ (%) | $El_2/El_1$ | Remarks |
| 1 | A | 44 | 30 | 12 | 12 | 2 | 12 | 150 | 1037 | 22.1 | 23 | 20.2 | 0.91 | Inventive Example |
| 2 | A | 68 | 27 | 2 | 1 | 2 | — | — | 875 | 21.1 | 24 | 19.2 | 0.91 | Comparative Example |
| 3 | A | 65 | 22 | 7 | 2 | 4 | — | — | 890 | 20.3 | 21 | 18.7 | 0.92 | Comparative Example |
| 4 | A | 67 | 10 | 16 | 5 | 2 | — | — | 945 | 18.1 | 24 | 17.2 | 0.95 | Comparative Example |
| 5 | A | 46 | 29 | 18 | 4 | 3 | — | — | 1080 | 16.4 | 22 | 15.0 | 0.91 | Comparative Example |
| 6 | A | 45 | 29 | 15 | 3 | 8 | — | — | 990 | 17.0 | 28 | 15.9 | 0.94 | Comparative Example |
| 7 | A | 45 | 50 | 1 | 2 | 2 | — | — | 945 | 17.3 | 31 | 15.8 | 0.91 | Comparative Example |
| 8 | A | 45 | 4 | 49 | 2 | 0 | — | — | 1103 | 12.4 | 14 | 11.2 | 0.90 | Comparative Example |
| 9 | B | 48 | 28 | 13 | 9 | 2 | 11 | 223 | 1081 | 19.1 | 39 | 17.0 | 0.89 | Inventive Example |
| 10 | B | 46 | 25 | 22 | 3 | 4 | — | — | 1098 | 15.2 | 28 | 14.1 | 0.93 | Comparative Example |
| 11 | B | 50 | 36 | 5 | 3 | 6 | — | — | 1025 | 16.0 | 24 | 14.5 | 0.91 | Comparative Example |
| 12 | B | 46 | 29 | 13 | 9 | 3 | 28 | 350 | 1011 | 16.6 | 24 | 15.8 | 0.95 | Comparative Example |
| 13 | B | 47 | 29 | 9 | 14 | 1 | 2 | 18 | 1029 | 20.8 | 22 | 16.7 | 0.80 | Comparative Example |
| 14 | B | 45 | 32 | 17 | 4 | 2 | — | — | 1082 | 17.1 | 23 | 15.2 | 0.89 | Comparative Example |
| 15 | B | 44 | 30 | 16 | 3 | 7 | — | — | 1077 | 16.7 | 23 | 15.9 | 0.95 | Comparative Example |
| 16 | B | 42 | 28 | 15 | 14 | 1 | 1 | 62 | 1019 | 20.1 | 18 | 15.9 | 0.79 | Comparative Example |
| 17 | C | 31 | 45 | 13 | 9 | 2 | 12 | 67 | 994 | 18.9 | 25 | 17.9 | 0.95 | Inventive Example |
| 18 | D | 24 | 45 | 13 | 15 | 3 | 16 | 409 | 1125 | 18.5 | 24 | 16.7 | 0.90 | Inventive Example |
| 19 | E | 68 | 18 | 11 | 3 | 0 | — | — | 802 | 24.2 | 40 | 22.3 | 0.92 | Comparative Example |
| 20 | F | 3 | 64 | 21 | 10 | 2 | 18 | 150 | 1211 | 11.3 | 14 | 10.2 | 0.90 | Comparative Example |
| 21 | G | 48 | 29 | 12 | 9 | 2 | 12 | 45 | 1062 | 19.5 | 23 | 17.6 | 0.90 | Inventive Example |

TABLE 3-continued

| No. | Steel type | Area fraction of steel sheet microstructure *1 (%) | *2 (%) | *3 (%) | *4 (%) | *5 (%) | *6 (%) | *7 (nm) | Tensile properties TS (MPa) | $El_1$ (%) | λ (%) | $El_2$ (%) | $El_2/El_1$ | Remarks |
|---|---|---|---|---|---|---|---|---|---|---|---|---|---|---|
| 22 | H | 31 | 42 | 12 | 12 | 3 | 17 | 132 | 984 | 19.1 | 25 | 17.8 | 0.93 | Inventive Example |
| 23 | I | 40 | 35 | 15 | 8 | 2 | 22 | 205 | 998 | 19.5 | 28 | 17.9 | 0.92 | Inventive Example |
| 24 | J | 29 | 52 | 12 | 3 | 4 | — | — | 1002 | 15.2 | 35 | 14.8 | 0.97 | Comparative Example |
| 25 | K | 48 | 30 | 11 | 9 | 2 | 21 | 235 | 992 | 20.3 | 24 | 18.7 | 0.92 | Inventive Example |
| 26 | L | 64 | 18 | 8 | 8 | 2 | 15 | 65 | 854 | 24.2 | 30 | 22.2 | 0.92 | Comparative Example |
| 27 | M | 24 | 44 | 17 | 13 | 2 | 9 | 58 | 1104 | 19.0 | 23 | 17.5 | 0.92 | Inventive Example |
| 28 | N | 0 | 67 | 18 | 12 | 3 | 21 | 102 | 1254 | 12.6 | 25 | 11.1 | 0.88 | Comparative Example |
| 29 | O | 42 | 30 | 14 | 12 | 2 | 12 | 145 | 1070 | 20.8 | 23 | 18.5 | 0.89 | Inventive Example |
| 30 | P | 32 | 41 | 12 | 13 | 2 | 10 | 285 | 1102 | 20.6 | 21 | 18.8 | 0.91 | Inventive Example |
| 31 | Q | 41 | 33 | 12 | 12 | 2 | 13 | 78 | 1045 | 21.0 | 23 | 18.5 | 0.88 | Inventive Example |
| 32 | R | 38 | 32 | 16 | 11 | 3 | 22 | 135 | 1005 | 18.9 | 28 | 16.8 | 0.89 | Inventive Example |
| 33 | S | 42 | 31 | 12 | 13 | 2 | 9 | 56 | 1039 | 21.2 | 24 | 19.5 | 0.92 | Inventive Example |
| 34 | T | 42 | 34 | 11 | 10 | 3 | 17 | 206 | 1024 | 18.6 | 23 | 16.6 | 0.89 | Inventive Example |
| 35 | U | 44 | 29 | 12 | 13 | 2 | 14 | 156 | 989 | 19.8 | 23 | 17.6 | 0.89 | Inventive Example |
| 36 | V | 42 | 29 | 15 | 12 | 2 | 15 | 150 | 1013 | 20.1 | 24 | 17.9 | 0.89 | Inventive Example |
| 37 | W | 42 | 30 | 14 | 12 | 2 | 10 | 95 | 1047 | 20.7 | 22 | 18.0 | 0.87 | Inventive Example |
| 38 | X | 39 | 33 | 15 | 11 | 2 | 12 | 58 | 1024 | 19.3 | 24 | 17.0 | 0.88 | Inventive Example |
| 39 | Y | 46 | 29 | 12 | 12 | 1 | 14 | 225 | 1021 | 18.4 | 27 | 17.5 | 0.95 | Inventive Example |
| 40 | Z | 42 | 35 | 12 | 10 | 1 | 15 | 251 | 997 | 18.5 | 22 | 16.9 | 0.91 | Inventive Example |
| 41 | A | 42 | 32 | 12 | 12 | 2 | 15 | 165 | 1025 | 20.6 | 23 | 17.9 | 0.87 | Inventive Example |
| 42 | A | 46 | 30 | 10 | 12 | 2 | 20 | 500 | 998 | 19.0 | 25 | 16.9 | 0.89 | Inventive Example |

*1: Area fraction of ferrite

*2: Total area fraction of bainite and tempered martensite

*3: Area fraction of fresh martensite

*4: Area fraction of retained austenite

*5: Area fraction of remainder

*6: Ratio of area fraction of cementite particles in retained austenite to area fraction of retained austenite

*7: Average major axis of cementite particles in retained austenite

The symbol "—" dicates that the area fraction of retained austenite was less than 7% and the measurements of the area fraction and the average major axis of cementite particles with a transmission electron microscope were not performed.

$El_1$: Total elongation in normal tensile test $El_2$: Total elongation at high strain rate $El_2/El_1$: Ratio of total elongation ($El_2$) in high-speed tensile test to total elongation ($El_1$) in normal tensile test The steel sheets of Inventive Examples each have a high strength, namely, a TS of 980 MPa or more, good ductility, and good stretch flangeability. In the steel sheets of Inventive Examples, the deterioration of ductility under high strain rate is suppressed. In contrast, the steel sheets of Comparative Examples were inferior to those of Inventive Examples in at least one of these items.

Example 2

The steel sheet No. 1 in Table 3 of Example 1 was formed by press forming to manufacture a member of Inventive Example. Furthermore, the steel sheet No. 1 in Table 3 of Example 1 and the steel sheet No. 9 in Table 3 of Example 1 were joined together by spot welding to manufacture a member of Inventive Example. It was confirmed that since the members of Inventive Examples have high strength, and in the members, cracking and necking in stretched portions and stretch flange portions occur rarely, and the deterioration of ductility under high strain rate is suppressed, the members of Inventive Examples can be suitably used for, for example, automotive parts.

The invention claimed is:

1. A steel sheet comprising:

a chemical composition containing, by mass %,

C: 0.07% or more and 0.25% or less,

Si: 0.01% or more and 2.0% or less,

Al: 0.01% or more and 2.0% or less, a total of Si and Al: 0.7% or more and 2.5% or less, Mn; 1.9% or more and 3.2% or less, P: 0.1% or less, S: 0.02% or less, and N: 0.010% or less, and optionally containing at least one selected from Cr, V, Mo, Ni, and Cu in a total amount of 1.0% or less, optionally containing at least one selected from Ti: 0.20% or less, and Nb: 0.20% or less, optionally containing B: 0.005% or less, optionally containing at least one selected from Ca: 0.005% or less, and REM: 0.005% or less, and optionally containing at least one selected from Sb: 0.05% or less, and Sn: 0.05% or less, with the balance being Fe and incidental impurities; and a steel microstructure including, in terms of area fraction, ferrite: 20% or more and 60% or less, a total of bainite and tempered martensite: 25% or more and 60% or less, retained austenite:

7% or more and 20% or less, fresh martensite: 8% or more and 40% or less, and the remainder:

5% or less, wherein cementite particles are present in the retained austenite, and the steel sheet has a ratio of an area fraction of the cementite particles in the retained austenite to an area fraction of the retained austenite is 5% or more and 25% or less, the steel sheet has a tensile strength of 980 MPa or more, and wherein the cementite particles in the retained austenite have an average major axis of 30 nm or more and 400 nm or less.

2. The steel sheet according to claim 1, further comprising a hot-dip galvanized layer or a hot-dip galvannealed layer on a surface of the steel sheet.

3. A member obtained by subjecting the steel sheet according to claim 1 to at least one of forming and welding.

4. A member obtained by subjecting the steel sheet according to claim 2 to at least one of forming and welding.

5. A method for manufacturing a steel sheet according to claim 1, the method comprising hot-rolling and cold-rolling a slab having the chemical composition; subsequently performing holding at an annealing temperature of 700° C. or higher and 950° C. or lower for 30 seconds or more and 1000 seconds or less; performing cooling from the annealing temperature to a cooling stop temperature of 150° C. or higher and 420° C. or lower at an average cooling rate of 10° C./s or higher; subsequently performing first holding under conditions in a temperature range of 380° C. or higher and 420° C. or lower for 10 seconds or more and 500 seconds or less; and further performing second holding under conditions of a temperature X° C. and a holding time Y second that satisfy formulae 1 to 3 below:

$$10000 \leq (273+X)\ (12+\log Y) \leq 11000 \quad \text{Formula 1}$$

$$440 \leq X \leq 540 \quad \text{Formula 2}$$

$$Y \leq 200 \quad \text{Formula 3.}$$

6. The method for manufacturing a steel sheet according to claim 5, wherein an average heating rate from a holding temperature in the first holding to the temperature X° C. in the second holding is 3° C./s or higher.

7. The method for manufacturing a steel sheet according to claim 5, wherein an average heating rate from a holding temperature in the first holding to the temperature X° C. in the second holding is 10° C./s or higher.

8. The method for manufacturing a steel sheet according to claim 5, comprising, between the first holding and the second holding or after completion of the second holding, forming a hot-dip galvanized layer or a hot-dip galvannealed layer on a surface of the steel sheet.

9. The method for manufacturing a steel sheet according to claim 6, comprising, between the first holding and the second holding or after completion of the second holding, forming a hot-dip galvanized layer or a hot-dip galvannealed layer on a surface of the steel sheet.

10. The method for manufacturing a steel sheet according to claim 7, comprising, between the first holding and the second holding or after completion of the second holding, forming a hot-dip galvanized layer or a hot-dip galvannealed layer on a surface of the steel sheet.

11. A method for manufacturing a member, the method comprising a step of subjecting a steel sheet manufactured by the method for manufacturing a steel sheet according to claim 5 to at least one of forming and welding.

12. A method for manufacturing a member, the method comprising a step of subjecting a steel sheet manufactured by the method for manufacturing a steel sheet according to claim 6 to at least one of forming and welding.

13. A method for manufacturing a member, the method comprising a step of subjecting a steel sheet manufactured by the method for manufacturing a steel sheet according to claim 7 to at least one of forming and welding.

14. A method for manufacturing a member, the method comprising a step of subjecting a steel sheet manufactured by the method for manufacturing a steel sheet according to claim 8 to at least one of forming and welding.

15. A method for manufacturing a member, the method comprising a step of subjecting a steel sheet manufactured by the method for manufacturing a steel sheet according to claim 9 to at least one of forming and welding.

16. A method for manufacturing a member, the method comprising a step of subjecting a steel sheet manufactured by the method for manufacturing a steel sheet according to claim 1 to at least one of forming and welding.

* * * * *